United States Patent [19]

Iwasaki

[11] 4,323,018

[45] Apr. 6, 1982

[54] METHOD FOR GENERATION OF HOT GAS BY INCINERATION OF COMBUSTILE MATERIAL AND APPARATUS FOR GENERATION OF HOT GAS BY INCINERATION OF COMBUSTIBLE MATERIAL

[75] Inventor: Yosimi Iwasaki, Date, Japan

[73] Assignee: Hokkaido Sugar Co., Ltd., Tokyo, Japan

[21] Appl. No.: 139,649

[22] Filed: Apr. 14, 1980

[30] Foreign Application Priority Data

Jun. 15, 1979 [JP] Japan ..... 54-74568

[51] Int. Cl.[3] ..... F23B 5/04; F23G 5/00

[52] U.S. Cl. ..... 110/208; 110/244

[58] Field of Search ..... 110/243-245, 110/235, 247, 251, 203, 208

[56] References Cited

U.S. PATENT DOCUMENTS 3,411,465 11/1968 Shirai ..... 110/245
3,727,563 4/1973 Hasselbring et al. ..... 110/244
3,885,507 5/1975 Dowy et al. ..... 110/243
4,063,521 12/1977 Pech ..... 110/208
4,159,000 6/1979 Iwasaki et al. ..... 110/244
4,248,164 2/1981 Isheim ..... 110/247

FOREIGN PATENT DOCUMENTS 55-823 1/1980 Japan ..... 110/245

*Primary Examiner*—Henry C. Yuen
*Attorney, Agent, or Firm*—Oblon, Fisher, Spivak, McClelland & Maier

[57] ABSTRACT

Method and furnace for the incineration of combustible material and the generation of hot gas, the furnace comprising a lower chamber provided with an inlet for air and an inlet for combustible material and an upper chamber provided with an inlet for air and a stack which chambers are communicated with each other inside the furnace, and the method comprising blowing air and combustible material into the lower chamber of the furnace in a direction tangential to the wall of the lower chamber and blowing air into the upper chamber of the furnace in a direction tangential to the wall of the upper chamber for thereby generating hot gas in the upper chamber.

3 Claims, 6 Drawing Figures

METHOD FOR GENERATION OF HOT GAS BY INCINERATION OF COMBUSTILE MATERIAL AND APPARATUS FOR GENERATION OF HOT GAS BY INCINERATION OF COMBUSTIBLE MATERIAL

BACKGROUND OF THE INVENTION

1. Field of the Invention

This invention relates to a method for generation of hot gas by incineration of combustible material and an apparatus for generation of hot gas by incineration of combustible material, which method and apparatus are advantageously applicable particularly to the incineration of granular materials such as rice hulls and which produce a combustion gas containing virtually no dust and, therefore, can be used directly as a heating gas.

2. Description of the Prior Art

U.S. Pat. No. 4,159,000 was recently issued to an invention titled "Method for sootless combustion and furnace for said combustion", made by the present inventor and filed with the U.S. Patent Office, with Japanese Patent Application No. 156474/1976 relied upon for the Convention priority. By use of a cylindrical furnace which is possessed of a funnel-shaped lower section and provided in the ceiling thereof with a stack, the patented invention mentioned above effects the combustion of a given material by blowing the material and air in a tangential direction into the furnace via an inlet disposed in the upper section of the furnace, whereby the incoming mixture of the material and air is made to flow in a fixed spirally ascending path along the inner wall of the furnace and burnt at the bottom of the furnace and the combustion gas from the combustion is wirled at the bottom of the furnace and is consequently made to rise in a spirally ascending path in the central portion of the furnace and is discharged through the stack. Although the aforementioned invention is highly effective in preventing pollution of the discharged combustion gas, it still has a possibility that a small portion of dust will be entrained by the combustion gas being released through the stack into the atmosphere. When the thermal energy retained by the discharged combustion gas is utilized as for drying raw cereal, therefore, the gas cannot be used directly and must be used indirectly through the medium of a heat exchanger, for example.

SUMMARY OF THE INVENTION

The object of this invention is to provide a method of combustion and a combustion furnace, which are applicable to the combustion of ordinary combustible materials, particularly advantageously to the combustion of agricultural refuse such as the hulls of cereals, and which produce a combustion gas which contains almost no dust and, therefore, can be used directly as a fluid heat medium for drying.

In the production of rice, wheat, etc., there occur large volumes of refuse such as hulls. Generally, such agricultural refuse is disposed of as by incineration. The total volume of the agricultural refuse is extremely large. When it is incinerated by an ordinary method by using a known combustion furnace, the combustion gas discharged contains a large amount of dust and is a cause for air pollution. The disposal of the agricultural refuse, therefore, constitutes a very important problem for farm owners.

The inventor, while continuing a study with a view to solving this problem, perfected the aforementioned earlier invention which was granted U.S. Pat. No. 4,159,000 as described above. Aware of the fact that the heat of combustion of the hulls is extremely large (for example, 3,400 to 3,600 Kcal/kg of rice hulls, a value about one third of the heat of combustion of petroleum fuel of the same weight) and the total volume of such hulls is extremely large, the inventor further continued a study for the purpose of developing a combustion technique which enables the combustion gas from the combustion of the agricultural refuse to be used directly as a heat source for drying without requiring the use of a heat exchanger, so as to contribute to the prevention of air pollution and ensure full utilization of the potential energy of the refuse. The present invention has been completed from this study.

To be specific, the method of the present invention, by use of a vertical cylindrical furnace having the interior thereof divided into an upper chamber and a lower chamber by a horizontal perforated partition wall, effects the incineration of a material subjected to combustion and the generation of hot gas by the steps of (1) continuously blowing air and the aforementioned material into the lower chamber via an inlet opening in the inner wall in the upper section of the lower chamber in a direction tangential to the wall of the lower chamber thereby allowing the incoming mixture of air and the material to form a spirally descending current of burning material along the inner wall of the lower chamber and causing the aforementioned current of burning material to deposit the incandescent residue of combustion on the bottom of the furnace and give rise to an incandescent layer of ash on the furnace bottom, (2) then causing the current of burning material to reverse its course and rise in a spirally ascending path along the inner side of the aforementioned spirally descending current of burning material, pass through the opening in the aforementioned perforated partition wall and enter the upper chamber and, in the meantime, (3) continuously blowing air into the upper chamber via an inlet opening in the inner wall in the upper section of the upper chamber in a direction tangential to the wall of the upper chamber thereby causing the incoming air to flow in a spirally descending path along the inner wall of the upper chamber and, upon arrival of the descending air flow at the upper surface of the partition wall, allowing part of the air to flow out of the furnace and the greater part thereof to proceed to engulf and entrain the current of burning material having risen from the lower chamber via the perforated partition wall into the upper chamber and give rise to a spirally ascending current within the upper chamber, causing the flammable portion still surviving in the current of burning material having entered the upper chamber to burn out, thereby causing the dust still entrained by the current of burning material having entered the upper chamber to be discharged out of the furnace in conjunction with the part of air being discharged at the level of the upper surface of the partition wall and, at the same time, causing the current constituted solely of hot air to be released into the atmosphere via the ceiling of the upper chamber, and (4) removing ash via the bottom of the lower chamber at the same rate the ash is produced by burning of the material so as to maintain constant the thickness of the incandescent layer of ash.

The furnace of the incineration of the combustible material and the generation of hot gas which is used for practicing the method of this invention comprises a vertical cylindrical furnace shell, a perforated partition wall disposed horizontally at one half of the entire height of the furnace shell so as to divide the interior of the furnace shell into an upper chamber and a lower chamber, a stack disposed so as to communicate with the interior of the upper chamber, an inlet formed to open in the inner wall in the upper section of the upper chamber to admit blown air into the upper chamber and an outlet for dust formed to open in the inner wall in the lower section of the upper chamber, two inlets formed to open in the inner wall in the upper section of the lower chamber, one for admitting blown air and the other for admitting supply of the combustible material respectively into the lower chamber, and a layer of incandescent ash and an outlet for discharging ash both formed in the bottom section of the lower chamber.

DETAILED DESCRIPTION OF THE PREFERRED EMBODIMENT

Figure 1:
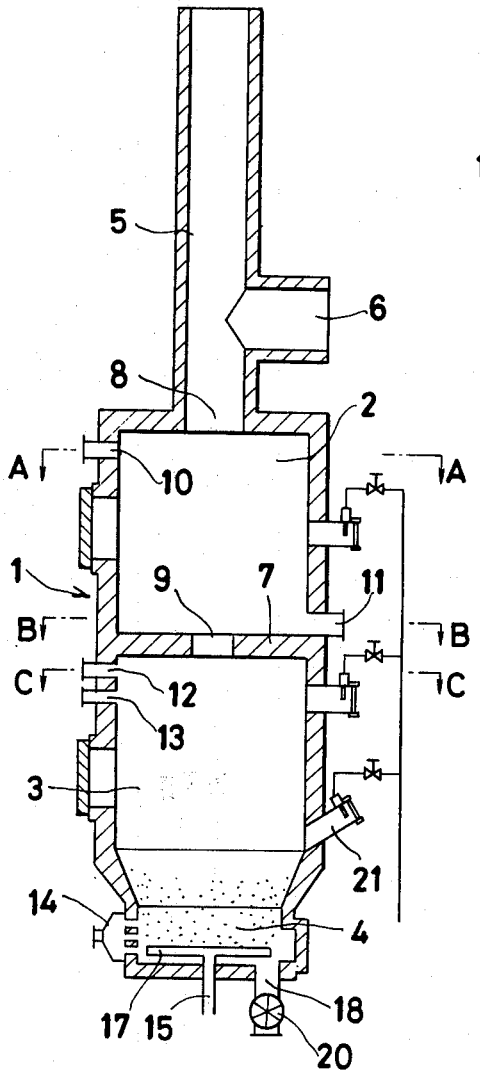
FIG. 1 is a sectioned view of the furnace for the incineration of combustible material and the generation of hot gas according to the present invention.

The combustible material burnable by the method and apparatus of this invention is not limited to rice hulls. Peanut shells, sawdust, orange rinds, sludge, municipal refuse, etc. can be also advantageously burned by this invention. Any combustible material can be used on the condition that it should be capable of assuming the form of small grains suitable for introduction, by blowing, into the cylindrical furnace, of mixing uniformly with air being simultaneously blown into the furnace to form a spiral current of burning material, and of being incorporated as glowing ash into the layer of incandescent ash on the furnace bottom upon collision with the layer. Thus combustible materials other than the rice hulls can be used after being ground to appropriate grain size and appropriately dried and, if required, mixed with other material to assure incorporation of the ash produced into the incandescent layer of ash. Optionally, such other materials may be used mixed with waste oil, for example. The opening of the perforated partition wall disposed inside the cylindrical furnace must be large enough for admitting, without any hindrance, the spirally ascending current of burning material from the lower chamber and the peripheral edge encircling this opening must be wide enough to enable the spirally descending current of air to reverse its course upon collision therewith. The opening of the stack formed in the ceiling of the upper chamber must be large enough for permitting uninterrupted discharge of the ascending current of air, and the outlet formed in the upper chamber for discharging the dust must open in the same direction as that of the spiral current of air introduced through the inlet for air. The inlet formed in the upper chamber for introducing air must open in the same direction as that of the inlet for air and that of an inlet for combustible material both formed in the lower chamber. The present invention has originated from the awareness fact that the combustion gas which is discharged from the furnace used for practicing the method of the sootless combustion according to the former invention of the present inventor contains a very small amount of dust and has a fairly high temperature and, therefore, cannot be used directly as a hot gas. It has been brought to perfection through a study made in search of a method which is capable of removing the very small amount of dust still remaining in the combustion gas and lowering the temperature of the gas to a suitable level. The invention specifically aims to provide an improved furnace which has disposed on top of the furnace of the aforementioned former invention a cylindrical body which is provided in the bottom with a perforation, in the ceiling with an opening for communication with a stack, in the inner wall with an inlet for air and at the lower end with an outlet for dust, whereby the very small amount of dust entrained by the hot combustion gas rising from the underlying furnace through the perforation into the overlying cylindrical body is separated and discharged through the outlet formed at the lower end of the cylindrical body. The temperature of the hot combustion gas reaching the overlying cylindrical body is made to fall to a suitable level by controlling the amount of air being blown into the cylindrical body via the inlet for air formed at the upper end side of the inner wall. Thus, the improved furnace of the present invention is capable of generating a hot gas solely of clean air. Depending on the kind of the combustion material used, more than one overlying cylindrical body can be stacked one on another on top of the underlying furnace.

Now, the improved furnace of the present invention will be described below with reference to one embodiment.

Figure 3:
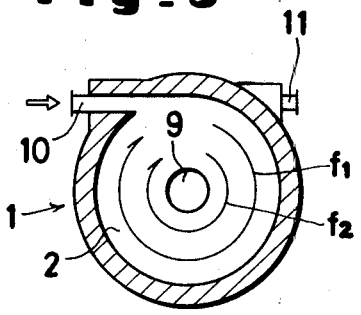
FIG. 3 is a cross section taken along the line A-A of the diagram of FIG. 1.
Figure 4:
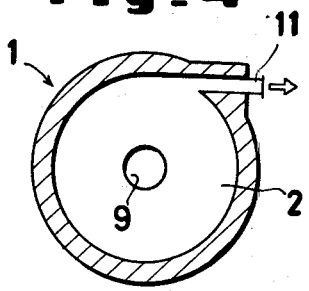
FIG. 4 is a cross section taken along the line B-B of the diagram of FIG. 1.
Figure 5:
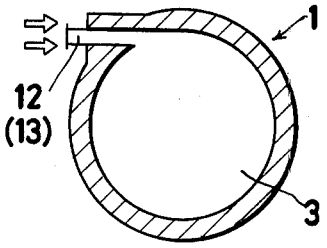
FIG. 5 is a cross section taken along the line C-C of the diagram of FIG. 1.
Figure 6:
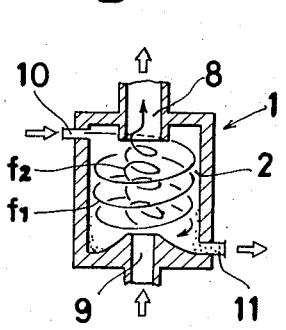
FIG. 6 is a diagram illustrating one preferred embodiment of the upper chamber in the furnace for the incineration of combustible material and the generation of hot gas according to the present invention.
Figure 2:
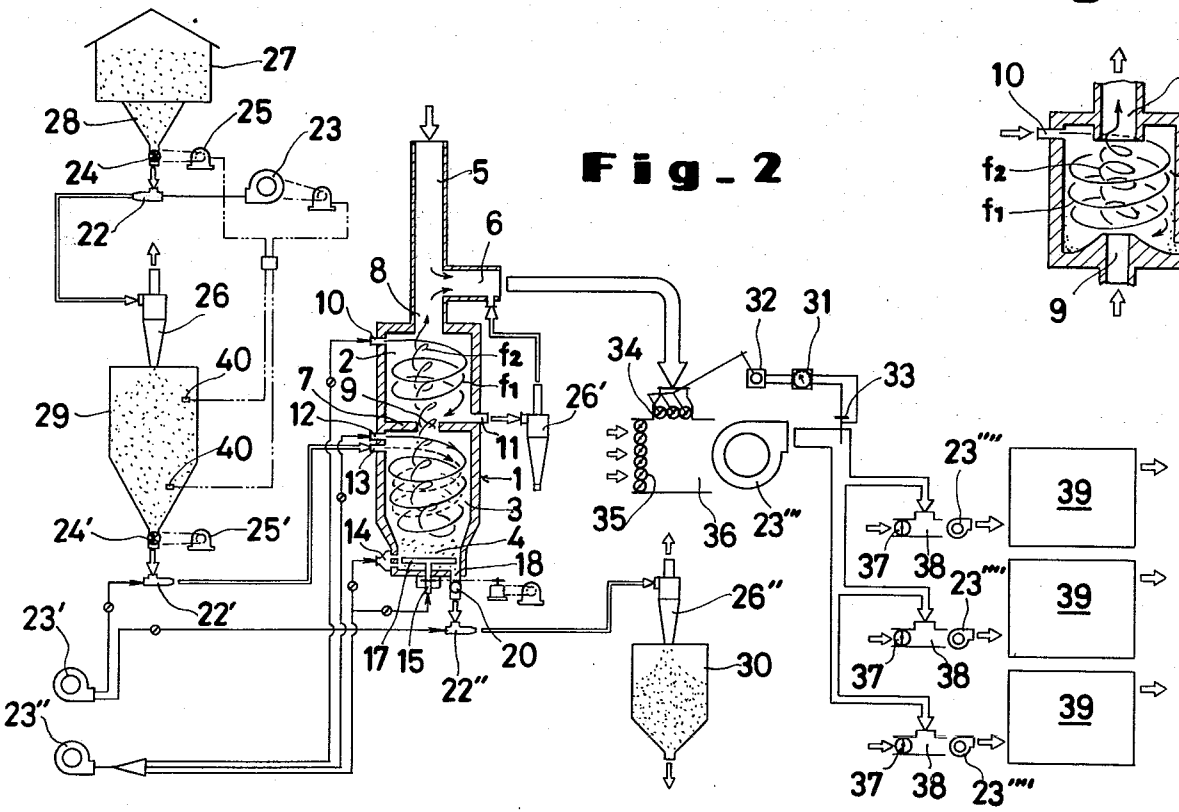
FIG. 2 is a drying system of the rice hull incineration type, incorporating therein a furnace of the incineration of combustible material and the generation of hot gas according to the present invention.

FIG. 1 is a longitudinally sectioned side view of the apparatus of the present invention, FIG. 2 is an explanatory diagram illustrating the manner in which a drying system incorporating the furnace of the present invention is put to use, FIGS. 3, 4 and 5 are cross sections taken along the lines A-A, B-B, and C-C respectively of the diagram of FIG. 1, and FIG. 6 is a longitudinal section of one embodiment of the upper chamber alone.

Now, one embodiment of the apparatus of this invention will be described with reference to FIG. 1. The interior of a vertical cylindrical furnace 1 is divided into an upper chamber 2 and a lower chamber 3 by a partition wall 7 possessed of a perforation 9 and disposed horizontally at one half of the entire height of the furnace. From an opening 8 in the ceiling of the upper chamber 2 is raised a stack 5 provided in one lateral side thereof with a side pipe 6. The upper chamber 2 is further provided at the top of its inner wall with an inlet 10 for blowing in air and at the bottom of its inner wall a dust outlet 11. The lower chamber 3 is provided with an inlet 12 for air and an inlet 13 for combustible material both opening in the inner wall in the upper section of the lower chamber. In the bottom portion a layer of incandescent ash 4 is formed and an inlet for air 14 is provided for the layer 4. By 17 is denoted a stirring rake containing a multiplicity of air injection holes to feed air to the layer 4. Denoted by 18, 20 and 21 are an outlet for combustion residue, a fixed-volume discharger for residue and an inspection window respectively. Optionally, the inlet 12 for air may be used concurrently as an inlet for the combustible material.

Now, a system wherein rice hulls are burned by use of the furnace of the present invention and the combustion gas discharged from the furnace is directly used for the purpose of drying will be described with reference to FIG. 2. The rice hulls stored in a bin 27 flow into a hopper 28, are forwarded in metered amounts by a fixed-volume feeder 24 and an infinitely variable motor 25 to an injection feeder 22, are then conveyed by a blower 23 into a cyclone 26, wherein the rice hulls are separated from the air and made to fall into a rice hull feeder tank 29 disposed thereunder. This feeder tank 29 is provided with lower-level switches 40, 40 and, therefore, is operated to start and stop the feeder 24 and the blower 23.

A blower 23', a fixed-volume feeder 24' provided with an infinitely variable motor 25' and an injection feeder 22' are used for further moving the rice hulls from the feeder tank 29 to a rice hull inlet 13. Another blower 23'' is used for parallelly supplying air to a secondary air inlet 12 of the furnace. The blower 23'' also serves to blow air to a primary air inlet 14 for use in the layer of incandescent ash 4 at the furnace bottom and to an air inlet 15 for use in cooling the stirring rake. In this case, the cooling air is blown into the layer of incandescent ash 4 through the multiplicity of holes in the stirring rake 17 to ensure substantially complete combustion of the solid component of the combustible material. The combustion, therefore, produces, as its residue, ashes of very low viscosity. The residue is forwarded by the fixed-volume residue discharger 20 from the outlet 18 to the injection feeder 22'' and thence conveyed via a cyclone 26'' into a residue storage tank 30.

In the meantime, the air and rice hulls which have been blown into the furnace via the inlet 12 and the inlet 13 respectively are made to descend spirally along the inner wall of the lower chamber 3 since the inlets open in the inner wall each in a tangential direction as illustrated in FIG. 5. During the descent, the radiant heat of the flame formed at the center of the lower chamber 3 liberates the volatile component and keeps the solid component carbonized. The solid component of the rice hulls, therefore, is made to accumulate in the layer of incandescent ash on the furnace bottom. The current of the liberated volatile component and air engulfs the flame rising from the layer of incandescent ash 4 and forms a spirally rotating current moving in the form of a tornado up the center of the lower chamber 3. By virtue of the combustion and the attendant expansion, the tornado-like flame gains in the intensity of its gyration. By this accelerated gyration, the solid component in the flame is made to pass into the spirally descending current formed on the outer side and eventually brought down to the layer of incandescent ash 4. The soot which has been sent flying, as a rule, is brought back to the furnace bottom, there to be burnt out. As a result, the combustion gas rises through the perforation 9 of the partition wall 7 into the upper chamber 2. Incidentally, at the upper end of the peripheral wall of the upper chamber 2, there is disposed an inlet for air 10 which opens in the inner wall in a tangential direction relative to the wall as illustrated in FIG. 3. The air which has been blown in through the inlet 10 gives birth to the spirally descending current $f_1$ along the inner wall of the upper chamber 2 and to the reversed spiral current $f_2$ moving up the inner side of the aforementioned spirally descending current $f_1$ toward the opening 8 in the ceiling. The reversal of the course of the current is accomplished because the spirally descending current $f_1$, on reaching the peripheral edge of the partition wall 7 in the upper chamber 2, is no longer allowed to keep its course but is pushed inwardly toward the center of the chamber 2 and then upwardly along the center to form a tornado-like spirally ascending current $f_2$. The combustion gas which has risen via the perforation 9 into the upper chamber 2 is immediately engulfed by the aforementioned reversed spiral current $f_2$ to form a uniformly diluted diabatic spiral current. The rich supply of oxygen in the newly added air enables the surviving combustible component in the current to be completely burnt within this chamber. The dust containing the residue from the combustion is centrifugally separated during its spiral ascent. This dust is made to fall spirally along the inner wall of the upper chamber 2 and is discharged through the dust outlet 11 by a small volume of air current.

The spirally descending current $f_1$ and the reversed spiral current $f_2$ rising up the inner side of the spirally descending current $f_1$ are, of course, moving in one same rotational direction and, therefore, do not interfere with each other. As a result, the dust which has been centrifugally moved to the outer periphery of the spirally ascending current $f_2$ is readily received into the spirally descending current $f_1$ and, while falling, moved away toward the outer periphery of the current, and eventually made to collide against the inner wall and fall down. This behavior of the dust falling gradually down the inner wall of the chamber is similarly obtained in the earlier invention. In the case of the upper chamber 2, however, because of the presence of the partition wall 7, the dust neither can be brought down to the layer of incandescent ash 4 and burnt out nor can be discharged in the form of ash. Thus, the dust centrifugally separated within the upper chamber having the vigorously gyrating current must be properly disposed of.

This problem has been solved by forming an outlet 11 at the lower end of the wall enclosing the chamber as described above to permit smooth removal of the dust in the lateral direction.

In this case, the dust outlet 11 is formed along the upper surface of the partition wall serving to intercept the spirally descending current $f_1$ as illustrated in FIG. 4 and it opens in the inner wall of the chamber in a tangential direction smoothly conforming with the direction of the spiral rotation of the current. Thus, the dust can be continuously blown out of this outlet in conjunction with a part of the air. The excess dust continues to move along the inner wall and gradually departs from the dust outlet 11. This dust outlet 11 need not be formed in the tangential direction as described above. Since the dust tends to collect in all the recesses formed in the inner wall until it fills the recesses to a level flush with the surrounding surface of the inner wall, the dust thus collecting in the recesses may be intermittently removed at proper intervals.

The clean hot gas which has been diluted and freed from the dust and which has had its temperature lowered from the level of 900° C. at the outlet to the level of about 700° C. within the upper chamber 2 finds its way through the opening 8 and, by virtue of the suction generated by the hot gas blower 23''', proceeds to the side pipe 6. The air for dilution is also drawn in via the stack 5 having an open end at the top and made to enter the same side pipe 6.

In the present illustrated embodiment, the air which has conveyed the dust through the dust outlet 11 is recovered by the cyclone 26' and introduced into the side pipe 6. Because of the suction generated by the hot gas blower 23''', there occurs a pressure difference between the dust outlet 11 of the upper chamber and the side pipe disposed on the outlet side of the cyclone 26'. Owing to this pressure difference, therefore, the discharge from the upper chamber of the current of air entraining the dust and the flow into the side pipe of the air current freed from the dust in the cyclone are effected very smoothly. As a result, the temperature of the hot gas is lowered in this side pipe 6 to the level of, say about 200° C.

The hot air of a temperature of about 200° C. within the side pipe 6 is drawn by the aforementioned blower 23''' and delivered via a regulating valve 34 and a suction duct 36 to one or more driers 39. The temperature regulator 31 disposed for automatically controlling the temperature of the hot gas supplied is a nullifying type temperature indicator/regulator which uses, as its immediate input, a thermocouple 33 disposed at the outlet side of the aforementioned blower 23'''. It effects the control of temperature by proportionally regulating the regulating valve 34 by means of a powered operator 32 to adjust the amount of the hot gas of 200° C. and mixing the hot gas within the suction duct 36 with cold gas (ambient air) introduced via the cold gas regulating valve 35. The resulting mixed air of controlled temperature is delivered to the driers 39 by means of the blowers 23'''' annexed respectively thereto.

The cold-gas regulating valves 37 annexed to the driers are normally kept closed. When the hot gas is required to have a temperature particularly lower than the ordinary drying temperature, they are opened to admit cold gas, which is mixed with the hot gas in the duct 38. The mixed air is then forwarded to the driers.

Now, the present invention will be described with reference to a working example.

EXAMPLE

A system for effecting the incineration of combustible material and the generation of hot gas according to the present invention was designed and built as illustrated in FIG. 2. The furnace used in the system was constructed of iron sheets 4.5 mm in thickness and an amorphous refractory linging material 150 mm in thickness. The dimensions of the furnace were as follows:

Inside diameter—950 mm:

Upper chamber: Height—950 mm: Diameter of air inlet—80 mm: Diameter of dust outlet—40 mm: Diameter of stack annexed—300 mm.

Lower chamber: As illustrated in FIGS. 1 and 2, the lower chamber had an upper cylindrical part and a lower downwardly tapered part. At the lowermost end, the inside diameter was 750 mm. Height: of the cylindrical part—950 mm of the tapered part—580 mm: Diameter of air inlet—50 mm: Diameter of inlet for combustible material—50 mm.

Diameter of perforation—230 mm

The stack was provided with a side pipe 300 mm in diameter, and a cyclone (consisting of a cylindrical section 260 mm in length and 250 mm in diameter and a conical section 550 mm in length) was disposed between the side pipe and the dust outlet of the uppe chamber.

Into the furnace described above, 280 $Nm^3$/hour of secondary combustion air at 18° C. was continuously blown in via the air inlet of the lower chamber, 60 kg/hour of rice hulls (composed of 10.12% of water, 14.95% of ash, 61.49% of volatile component and 13.44% of fixed carbon; heat of combustion 3416 Kcal/kg and bulk density 0.1 $T/m^3$) and 70 $Nm^3$/hour of air at 18° C. through the inlet for combustible material, 400 $Nm^3$/hour of air at 18° C. through the air inlet of the upper chamber and 50 $Nm^3$/hour of air at 18° C. through the air inlet communicating with the stirring rake of the lower chamber, to effect combustion of the rice hulls.

At the same time, the blower disposed in the suction duct was started to draw in 2050 $Nm^3$/hour of air at 18° C. through the top of the stack and 8990 $Nm^3$/hour of air at 21° C. through the suction duct. Consequently, in the bottom of the lower chamber, a layer of incandescent ash of a thickness within the range of from 50 to 58 cm was formed constantly and 8.5 kg/hr of residue (composed of 0.27% of water content, 99.18% of ash, 0.43% of volatile component and 0.12% of fixed carbon) was discharged and 50 g/hour of dust was released from the cyclone. Various parts of the furnace were tested for gas temperature, gas composition, dust concentration, gas flow volume and gas pressure. The results were as shown below.

TABLE 1

(Gas temperature)

| Position tested | Middle section of lower chamber | Lower section of upper chamber | Joint between upper chamber and stack | End of side pipe | Outlet of blower for driers |
|---|---|---|---|---|---|
| Temperature (°C.) | 1200 | 1150 | 610 | 200 | 66 |

TABLE 2

(Gas composition)

| Position tested | Composition | | | |
|---|---|---|---|---|
| | $CO_2$ | $O_2$ | CO | $N_2$ |
| Joint between upper chamber and stack | 6.8% | 11.4% | 0% | 81.8% |

TABLE 3

(Dust concentration)

| Position tested | Concentration of dust |
|---|---|
| Side pipe | 0.08 g/$Nm^3$ |
| Outlet of hot gas blower | 0.02 g/$Nm^3$ |

TABLE 4

(Gas flow volume)

| Position tested | Side pipe | Outlet of hot gas blower | Joint between upper chamber and stack |
|---|---|---|---|
| Flow volume ($Nm^3$/hr) | 2880 | 11870 | 830 |

TABLE 5

(Gas pressure)

| Position tested | Upper section of stack | Side pipe | Inlet to cyclone | Outlet of cyclone |
|---|---|---|---|---|
| Pressure (mmHg) | −2 | −20 | 35 | −17 |

It is seen that the dust concentration was substantially close to 0 and that the hot gas could be utilized, in its unaltered form, for the driers.

It is clear from the foregoing description that, in the present invention, all the steps of operation, namely, the feeding of rice hulls from its bin 27, the blowing of hot gas into the driers 39 and the delivering of the residue of combustion to the residue storage tank require no manual work during the operation of the system, except for the change in the controlled temperature due to the change in the working conditions on the part of the driers. When the blower 23''' serving to draw the hot gas from the furnace and deliver it to the driers is stopped by a mechanical trouble or stopped temporarily by reason of some operational necessity, the hot gas generated in the upper chamber 2 is released into the atmosphere via the stack 5. Thus, the system's safety is not jeopardized by stopping of the blower. Since the air current which descends along the inner wall of the furnace 1 keeps the furnace shell cooled, the refractory material to be used to line the wall of the furnace serves its purpose sufficiently with a small thickness of 150 mm (more than 350 mm of thickness is generally required in other furnaces). Thus, this invention promises a notable saving in the cost of refractory material. It further enjoys the advantage that the construction of the furnace is very simple and the floor area required for its installation is small.

What is claimed is:

1. A furnace for the incineration of combustible material and the generation of hot gas, which comprises:

a vertical cylindrical furnace having a wall;

a partition wall provided in the center thereof with an aperture and disposed horizontally at one half of the entire height of the furnace so as to divide the interior of the furnace into an upper chamber and a lower chamber, a stack annexed to the top of the furnace and provided with a side pipe, a first inlet for air disposed in said wall at the upper end of said upper chamber and positioned so as to open in the direction tangential to said wall of the furnace, an outlet for dust disposed in said wall at the lower end of the upper chamber and positioned so as to open in the direction tangential to said wall of the furnace and in the same directional sense as that of said first inlet of air, a second inlet for air and an inlet for combustible material, both disposed in said wall at the upper end of said lower chamber and positioned so as to open in the direction tangential to the wall of the furnace and in the same directional sense as that of said first inlet for air in the upper chamber, and means for supporting an incandescent layer of ash and an outlet for residue of combustion, both disposed in the bottom section of said lower chamber, whereby the air and combustible material introduced through said second inlet and said inlet for combustible material form a first spirally descending current of burning material, and whereby a second spirally ascending second current is formed within said first current and passes through said aperture into said upper chamber, and further whereby the air introduced through said first inlet forms a third spirally descending current surrounding said second spirally ascending current in said upper chamber.

2. The furnace according to claim 1, wherein said second inlet for air in the lower chamber concurrently serves as said inlet for combustible material.

3. The furnace according to claim 1, wherein said lower chamber is provided in the bottom section thereof with a stirring rake containing a multiplicity of injection holes.

* * * * *

UNITED STATES PATENT AND TRADEMARK OFFICE

CERTIFICATE OF CORRECTION

PATENT NO. : 4,323,018

DATED : April 6, 1982

INVENTOR(S) : Yosimi Iwasaki

It is certified that error appears in the above—identified patent and that said Letters Patent is hereby corrected as shown below:

Please correct the title of the invention to read as follows:

[54] -- METHOD FOR GENERATION OF HOT GAS BY INCINERATION OF COMBUSTIBLE MATERIAL AND APPARATUS FOR GENERATION OF HOT GAS BY INCINERATION OF COMBUSTIBLE MATERIAL --

Signed and Sealed this

*Thirteenth* Day of *July 1982*

[SEAL]

*Attest:*

GERALD J. MOSSINGHOFF

*Attesting Officer*

*Commissioner of Patents and Trademarks*